US005238182A

United States Patent [19]

Loch

[11] Patent Number: 5,238,182

[45] Date of Patent: Aug. 24, 1993

[54] FOUR PART FORM FROM TWO SHEETS

[75] Inventor: Mark D. Loch, Whitehall, Pa.

[73] Assignee: Moore Business Forms, Inc., Grand Island, N.Y.

[21] Appl. No.: 861,388

[22] Filed: Mar. 31, 1992

[51] Int. Cl.[5] ..... B65D 27/04; B65D 27/06

[52] U.S. Cl. ..... 229/304; 229/69; 229/71

[58] Field of Search ..... 229/303, 304, 69, 71

[56] References Cited

U.S. PATENT DOCUMENTS

| | | | |
|---|---|---|---|
| 3,802,618 | 4/1974 | Wiessner | 229/304 |
| 3,988,971 | 11/1976 | Steidinger | 93/63 |
| 4,055,294 | 10/1977 | Traise | 229/304 |
| 4,756,468 | 7/1988 | Jenkins | 229/73 |
| 4,769,969 | 9/1988 | Minami | 53/117 |
| 4,779,792 | 10/1988 | Lombardo | 229/303 |
| 4,809,906 | 3/1989 | Lombardo | 229/73 |
| 4,927,072 | 5/1990 | Jenkins et al. | 229/92.3 |
| 5,039,000 | 8/1991 | Ashby | 229/304 |
| 5,062,570 | 11/1991 | Ashby | 229/69 |
| 5,154,344 | 10/1992 | Loch | 229/304 |

*Primary Examiner*—Stephen P. Garbe

*Attorney, Agent, or Firm*—Nixon & Vanderhye

[57] ABSTRACT

A mailer type business form having four parts is produced from two sheets, to define a mailer having top and bottom plies formed from one sheet, and first and second intermediate plies formed from another sheet. The top and first intermediate plies have aligned die cut windows in them, and the second intermediate ply forms a return envelope with the bottom ply. A combination outgoing address for the mailer, and return address for the return envelope, are printed on a portion of the second intermediate ply readily visible through the die cut windows. During production of the mailer, slugs are cut out of one of the sheets, and removed by vacuum or a blast of pressurized gas, and the first and second sheets are merged together, adhesive being applied to the sheets to attach them together.

10 Claims, 3 Drawing Sheets

FOUR PART FORM FROM TWO SHEETS

BACKGROUND AND SUMMARY OF THE INVENTION

The invention relates to a simple and effective procedure for a making a four part mailer type business form from two sheets of paper. It is highly desirable to be able to construct mailers in a simple and relatively expensive manner because of the competitiveness of the mailer business.

In addition to providing a method for simply and easily constructing four part mailers from two sheets, according to the present invention a mailer is provided that has simplicity of construction, yet readily utilizable components, including an "invoice" portion, or like insert, and a return envelope. The mailer is also constructed so that there is a minimum of variable information that need be printed thereon.

According to one aspect of the present invention, a method of constructing a mailer type business form from first and second sheets is provided comprising the following steps: (a) Feeding first sheets in continuous format in a first path. (b) Cutting at least one slug from each first sheet in the continuous format. (c) Removing the cut slugs from the first path. (d) Feeding second sheets in continuous format in a second path. (e) Applying adhesive to each of the second sheets on a first face thereof. (f) Providing a die cut window in each of the first and second sheets. And (g) merging the first and second paths to bring the adhesive from each of the second sheets into contact with a first sheet, and so that the die cut windows match.

Prior to steps (a) and (d), it is preferred to print all non-variable information on the first and second sheets. Variable information is subsequently printed, including printing as a return address on a return envelope formed by the first and second sheets an outgoing address for the mailer produced by the method of the invention, the combination return and outgoing address being visible from the exterior of the mailer through the die cut outs, and being right side up as both an outgoing address and a return address. When the non-variable information is being printed, a plurality of perf lines may be provided in each of the second sheets.

In a the preferred method, step (b) is practiced to cut a slug which extends perpendicular to the first path, across the entire width of the form, and there are the further step of (h) applying an adhesive strip (e.g. via transfer tape) to each of the second sheets at a portion thereof which will be in alignment with the perpendicular slug when the sheets are merged, step (h) being practiced prior to step (g). Preferably, three slugs are cut from each first sheet, and step (c) is practiced by removing at least one of the slugs with a source of vacuum, and at least one of the slugs with a blast of pressurized gas.

According to another aspect of the present invention a mailer type business form is provided having a plurality of quadrate plies, comprising a top ply, first and second intermediate plies, and a bottom ply. The top ply and the intermediate ply are of substantially the same width, and in face to face engagement, and have aligned die cut windows formed therein. The second intermediate ply and the bottom ply form a return envelope, the second intermediate ply having a width less than that of the first intermediate ply having and the top and bottom plies, with a pair of longitudinal strips being disposed along the longitudinal edges of the bottom ply exterior of the second intermediate ply. Means defining lines of weakness in the bottom ply are provided at the area between the second intermediate ply and the longitudinal strips. And, indicia is provided on the second intermediate ply visible through the aligned die cut windows formed in the top and first intermediate plies. The indicia preferably comprises a combined outgoing address for the mailer and a return address for the return envelope, the combined address being right side up on the second intermediate ply. A transparent patch may be disposed over the die cut window in the top ply, but one is not necessary for the die cut window in the first intermediate ply.

The second intermediate ply has a length less than the length of the bottom ply, a cross strip being provided in the bottom ply overlapping the second intermediate ply. Adhesive covered by a release strip is provided on the cross strip, to provide the sealing mechanism for the return envelope.

A plurality of patterns of heat sealable adhesive are disposed on the first and second intermediate plies, and connect them together, and connect the first intermediate ply to the bottom ply, along removable edge portions. Adhesive patterns also connect the first intermediate ply to the top ply along three edges of the first intermediate ply, but not the fourth edge thereof (which is the edge closest to the return envelope). Means are also provided defining lines of weakness —such as perforations—in the top ply and the intermediate ply corresponding to the lines of weakness in the bottom ply.

According to still another aspect of the present invention a mailer type business form having a plurality of quadrate plies, comprising a top ply, first and second intermediate plies, and a bottom ply, is provided. The top ply and the first intermediate ply are of substantially the same width, and in face to face engagement, and have aligned die cut windows formed therein. The second intermediate ply and the bottom ply form a return envelope, the second intermediate ply having a width less than that of the first intermediate ply and the top and bottom plies, with a pair of longitudinal strips being disposed along the longitudinal edges of the bottom ply exterior of the second intermediate ply. Means are provided defining lines of weakness in the bottom ply at the area between the second intermediate ply and the longitudinal strips. And, means are provided defining lines of weakness in the top ply and intermediate ply corresponding to the lines of weakness in the bottom ply, to allow ready detachment of edge portions of the mailer, to expose the return envelope when the edge portions are detached.

Its is a primary object of the present invention to provide for the effective and simple production of a four part mailer from two sheets of paper, the mailer being simple and versatile. This and other objects of the invention will become clear from an inspection of the detailed description of the drawings.

DETAILED DESCRIPTION OF THE DRAWINGS

Figure 1:
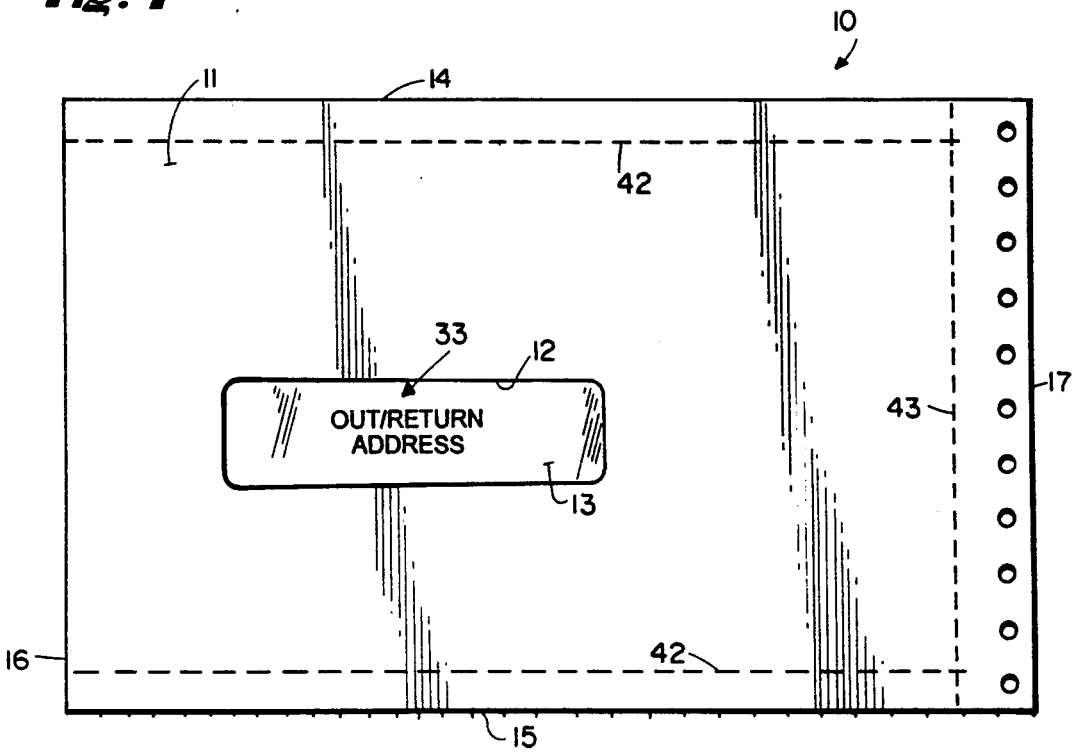
FIG. 1 is a top plan view of an exemplary mailer produced according to the invention.
Figure 3:
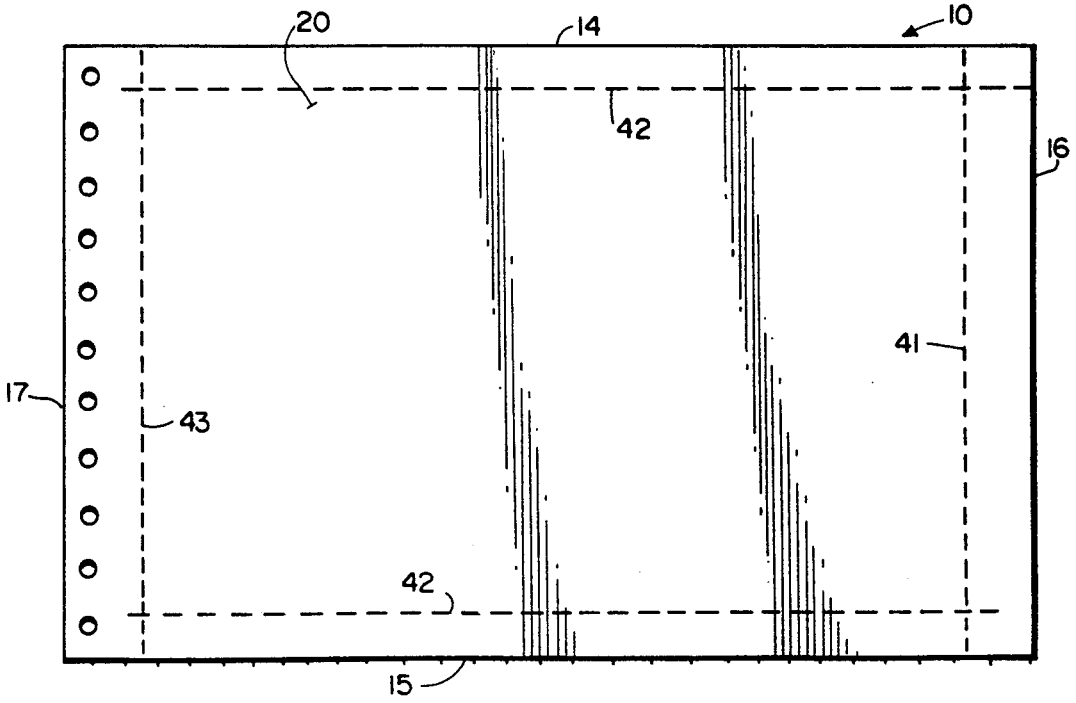
FIG. 3 is a bottom plan view of the mailer of FIGS. 1 and 2.
Figure 2:
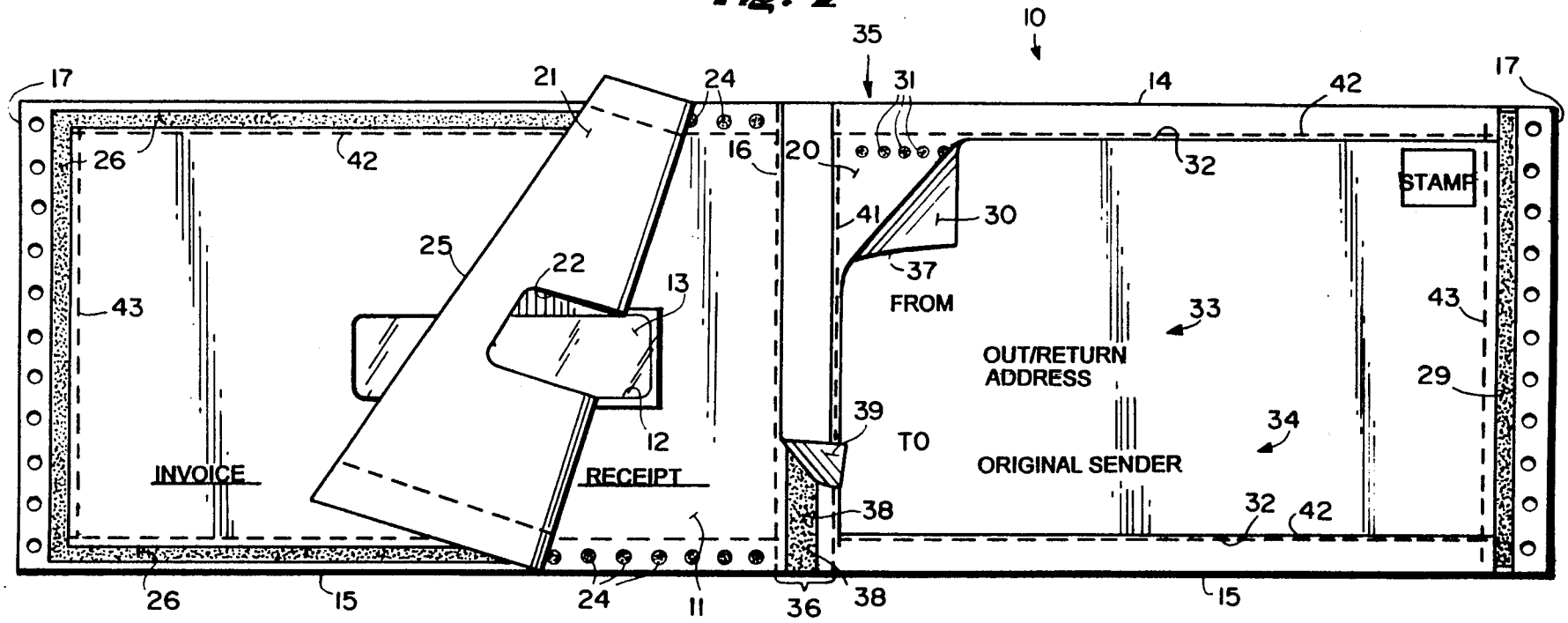
FIG. 2 is a top plan view of the mailer of FIG. 1 opened up to expose the internal components, and with the internal components peeled partially away for clarity of illustration.

An exemplary mailer produced according to the present invention is shown generally by reference numeral 10 in FIGS. 1 through 3. The mailer includes a top ply 11 (see FIG. 1) that has a die cut out 12 formed therein preferably with a transparent (e.g. glassine) patch 13 covering the die cut out 12, a top edge 14, a bottom edge 15, and side edges 16, 17. The top ply 11—as all the rest of the plies of the mailer—is substantially quadrate in configuration.

The mailer 10 also comprises a bottom ply 20 (FIG. 3) having edges 14 through 16 in common with the top ply 11 in the formed mailer. The plies 11, 20 are formed from the same original paper sheet.

The interior of the mailer 10 is illustrated in FIG. 2, and includes a first intermediate ply 21 having a die cut out window 22 therein which is aligned (in the constructed mailer 10) with the die cut out window 12 in the top ply 11. No transparent patch is necessary over the die cut out window 22, and preferably none is provided. The first intermediate ply 21 is affixed to the top ply 11 with spaced adhesive dots 24 or the like which extend adjacent both the edges 14 and 15 of the top ply. However, the edge 25 of the quadrate first intermediate ply 21 is a free edge, not being attached by adhesive, the edge 25 being the closest edge to the rest of the form (including the return envelope which will be hereinafter described). As can be seen in FIG. 2, the side edge 16 of the plies 11, 20 is formed by a line of weakness, such as a perforation 16.

Disposed along each of the edges 14, 15, 17 of the first intermediate ply 21—but not adjacent free edge 25 thereof—preferably are adhesive strips 26, or like patterns. Preferably the adhesive in strip 26 is heat activated adhesive, which will be used to attach the first intermediate ply 21 to the bottom ply 20, cooperating with the adhesive strip 29 seen on the right hand side of FIG. 2.

A second intermediate ply 30 is provided which has a smaller width than the rest of the plies 11, 20, 21, and forms with the bottom ply 20 a return envelope. The second intermediate ply 30 is attached to the bottom ply 20 with spaced adhesive dots 31 or the like which are provided adjacent both the edges 32 thereof, as well as adjacent the edge 17 (which it has in common with the bottom ply 20). Note that while the second intermediate ply 30 is substantially quadrate, as illustrated in FIG. 2, the rightmost portion thereof has the same width as the bottom ply 20.

Printed as variable information on the top of the return envelope (the top of second intermediate ply 30 as viewed in FIG. 2) is a combination outgoing address for the original mailer 10, and return address for the return envelope, 33. This address information 33 is visible through the die cut windows 12, 22 from the exterior of the form (see FIG. 1), and is right side up with respect to both the original mailer 10 and the return envelope. Printed as either non-variable information, or under some circumstances as variable information, is address 34, e.g., the address of the original sender of the mailer 10 address (which also is preferably printed as a return address on the mailer top ply 11, not shown in the drawings).

To the left of the return envelope—which is illustrated generally by reference numeral 35—is a flap portion 36 thereof which seals the open edge 37 of the return envelope after an insert is provided therein. A strip of adhesive 38—preferably pressure sensitive adhesive covered by a transfer tape 39—seals the flap 36 closed. After detachment of the return envelope 35 from the left side of the form along perforation 16, and insertion of the invoice portion of first intermediate ply 21, or the like, within the return envelope 35, the transfer tape 39 is removed and the flap 36 is folded over along the line 41 (which may be a score line, line of weakness—such as a perforation—or the like), to secure the flap with adhesive 38.

Note that additional lines of weakness (preferably perforations) are provided in each of the plies 11, 20, 21 spaced from the edges 14, 15 thereof, and illustrated by reference numeral 42 in the drawings. Also perforations 43 are provided in all of the plies adjacent the common edges 17. Note that adhesive (not shown) is provided in a pattern form between the plies 20, 30 adjacent the perforation 43 (to the left thereof as viewed in FIG. 2) to assist in forming the return envelope 35.

Figure 4:
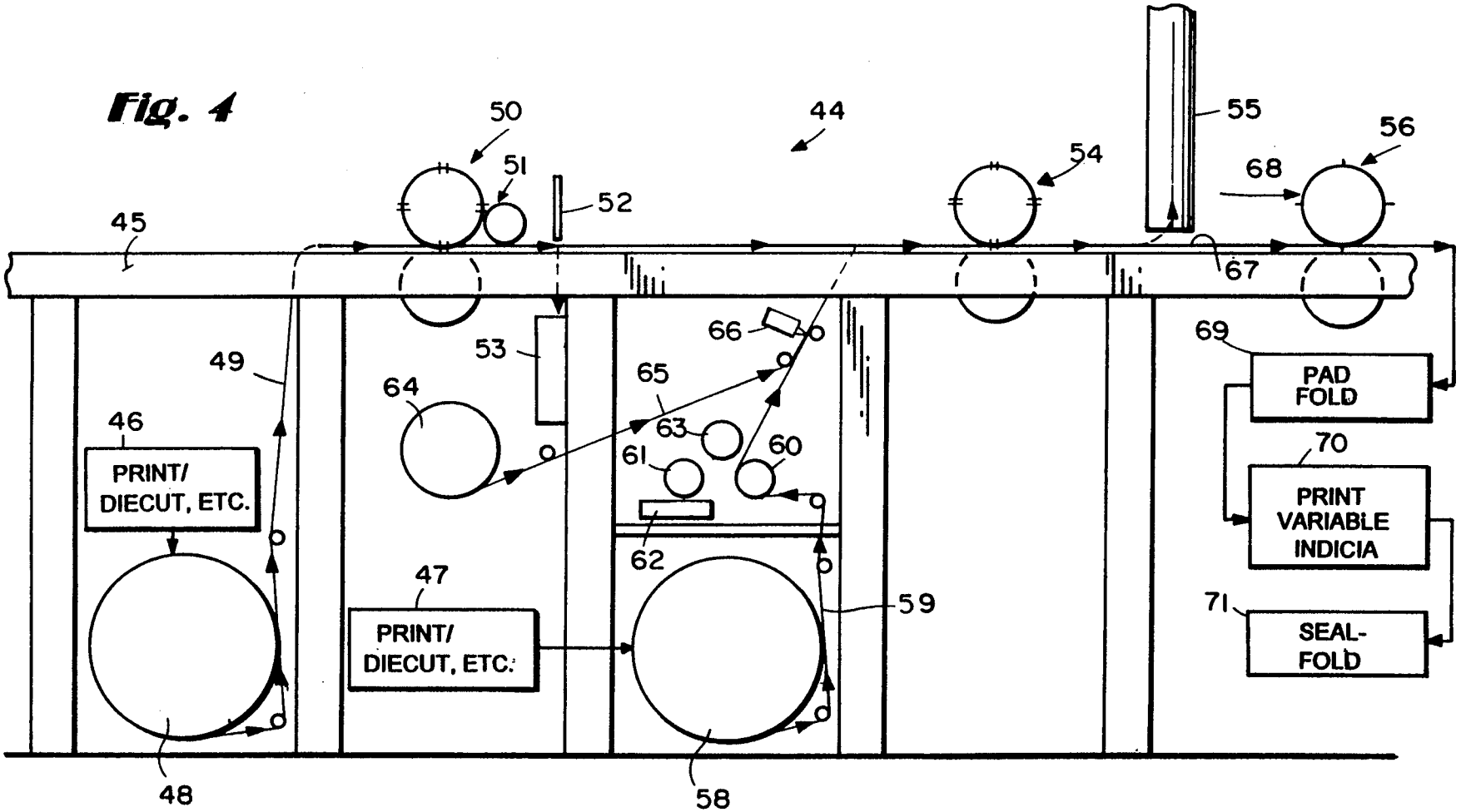
FIG. 4 is a side schematic view of exemplary apparatus utilized to practice the method according to the invention and to produce the mailer of FIGS. 1 through 3.

Exemplary apparatus for producing mailers 10 according to the present invention is illustrated generally by reference numeral 44 in FIG. 4, and includes as a first major component thereof frame 45. However, even prior to the components of the forms being delivered to the machine 44 they are treated by apparatus shown schematically by reference numerals 46 and 47 in FIG. 4. In particular, two sheets of paper, in continuous roll format, are first printed with all of the non-variable information on a conventional printing press, then wound onto a roll and delivered to an offline machine known as an "84" machine where the die cut windows 12, 22 are formed therein. Also, the same machine applies the patch 13 over the die cut window 12, and applies the heat activated adhesive 26, 29 on a first sheet. If the second sheet includes the heat activated adhesive 28 (which is optional), the same machine will apply it. From the "84" machine the sheets are again wound up in roll form and then mounted on shafts in association with the frame 45 of the machine 44.

The first sheet is in the form of a roll 48 and is illustrated in continuous sheet format at 49. The sheets 49 in a preferred embodiment preferably have a width of about 18 inches (the distance between the edges 17 in FIG. 2), and will ultimately be cut into mailers 10 having a length (the distance between the edges 14, 15 in FIG. 2) of about 5½ inches. Each individual sheet to be formed from continuous format sheet 49 forms one mailer 10. The continuous sheet travels into a first perf cylinder 50 where the individual sheets are cut from the continuous web of sheets 49. Cylinder 50 has eight pre-spaced cutting blades positioned (in the preferred embodiment) about ⅝ inch from the right sheet edge and terminating about ⅝ inch to the right of the center of the form. These blades will thus cut an approximately ⅜ inch wide slug every 5½ inches, thus providing the proper height of the face of the return envelope—that is they will cut from the ultimate ply 30 of the mailer 10 that portion originally above and below the edges 32 as seen in FIG. 2. That is, the slugs are outside of the edges 32. However, the slugs remain part of the first sheet until the sheet comes into contact with the vertical perf wheel 51. The perf wheel 51 has four special blades or perf wheels that first form the leftmost perforation line 43 in what is ultimately the first intermediate ply 21 (see FIG. 2), and then form the edge 25 of what becomes the first intermediate ply 21, and then forms the edge 37 of what becomes the second intermediate ply 30, and finally a fourth blade which forms the rightmost perforation 43 as viewed in FIG. 2.

After the slugs above and below the edges 42, and between the edge 37 and the perforation 43, have been cut from the first sheet (the portion thereof that will ultimately form second intermediate ply 30) the cut slugs are removed from the path in which the first sheets 49 are traveling. This is accomplished in the embodiment illustrated in FIG. 4 utilizing one or more tubes 52 connected up to a source of pressurized gas, providing an air blast that is timed to coincide with the passage of the slugs underneath the tubes 52, so that the slugs are deposited in the waste removal system 53. Subsequently, the sheets 49 pass to the horizontal perf cylinder 54, and then to a suction tube 55. The suction tube 55 removes the slug that remains between the edges 25, 37 of the first sheet, which will form the intermediate plies 21, 30, that slug being attached by small paper ties to the plies 21, 30, and readily being sucked up into the tube 55. The sheets then go to the horizontal perf cylinder 56.

A roll 58 for second sheets 59 in continuous form is also mounted for rotation with respect to the frame 45. It is webbed through a pasted pocket unit where glue dots 24, 31 are applied. The mechanisms for doing this, shown schematically in FIG. 4, include an impression cylinder 60, the glue pick up cylinder 61, the glue source 62, and the plate cylinder 63. Transfer tape 65 from roll 64 is passed into the appropriate position in association with the second sheets 59, and is laid down in register over flap 36 to allow sealing of the return envelope. Two vertical glue streams (not shown in FIG. 2) are applied at this point (at 66), one that will glue the left side of plies 21 and 20 together in stub 17, and the second will glue plies 30 and 20 together in the stub 17 at the right. After the nozzle 66, the path of the second sheets 59 and the path of the first sheets 49 are merged together (just prior to horizontal perf cylinder 54) to form a composite web 67.

At the horizontal perf cylinder 54, the perfs 42 are provided in the applicable portions of both sheets, and the third perf cylinder 56 perfs the web horizontally every predetermined distance (typically about every 5½ inches), i.e., the perforations 16, 41. Then the combined forms pass to a conventional apparatus 69 for folding the components that will produce the final forms 10 into pad form (e.g., every 11 inches). From the equipment 69 the forms may then be shipped to an entity that will use the forms, e.g. by feeding the forms into printing equipment 70 which will print variable indicia thereon, such as the address information 33 (the information 34 typically, although not necessarily being printed at 46). After the variable information is applied, the sheets are fed to the conventional sealer-folder 71 so that the form is folded in half on perf 16. In this condition then the form is as illustrated in FIG. 1, with the outgoing-/return address information 33 visible through the cut outs 12, 22.

It will thus be seen that utilizing the equipment 44, a method is provided which comprises the following steps: Feeding first sheets 49 in continuous format in a first path. Cutting (utilizing apparatus 50, 51) at least one slug from each first sheet in the continuous format 49. Removing the cut slugs from the first path (using air blast 52 and suction conduit 55). Feeding second sheets in continuous format 59 in a second path. Applying adhesive (24, 31) to each of the second sheets on the first face thereof (the upper face of plies 11, 20 as viewed in FIG. 2). Providing a die cut window (12, 22) in each of the first and second sheets. Merging the first and second paths to bring the adhesive from each of the second sheets into contact with the first sheet, and so that the die cut windows 12, 22 match (see the merged component 67 in FIG. 4). Applying adhesive, with the transfer tape 39, to the sheets in their direction of movement in the combined first and second path (see arrow 68). And printing a return address 33 on the return envelope 35 formed by the first and second sheets, an outgoing address for the mailer 10, the combined return and outgoing address 33 being visible from the exterior of the mailer 10 through the die cut outs 12, 22 (see FIG. 1), and being right side up as both an outgoing address and a return address.

It will thus be seen that according to our present invention a four part mailer is constructed from two sheets in a simple and effective manner. While the invention has been herein shown and described in what is presently conceived to be the most practical and preferred embodiment thereof, it will be apparent to those of ordinary skill in the art that many modifications may be made thereof within the scope of the invention, which scope is to be accorded to be accorded the broadest interpretation of the appended claims so as to encompass all equivalent methods and products.

What is claimed is:

1. A mailer type business form having a plurality of substantially quadrate plies, comprising a top ply, first and second intermediate plies, and a bottom ply;

said top ply and said first intermediate ply being of substantially the same width, and in face to face engagement, and having aligned die cut windows formed therein;

said second intermediate ply and said bottom ply forming a return envelope, said second intermediate ply having a width less than that of said first intermediate ply and said top and bottom plies, with a pair of longitudinal strips being disposed along the longitudinal edges of said bottom ply exterior of said second intermediate ply;

means defining lines of weakness in said bottom ply at the area between said second intermediate ply and said longitudinal strips; and indicia provided on said second intermediate ply visible through said aligned die cut windows formed in said top and first intermediate plies.

2. A mailer as recited in claim 1 wherein said indicia comprises a combined outgoing address for said mailer, and a return address for said return envelope, both addresses being right side up.

3. A mailer as recited in claim 1 further comprising a transparent patch disposed over said die cut window in said top ply.

4. A mailer as recited in claim 1 wherein said second intermediate ply has a length less than the length of said bottom ply, a cross strip being provided in said bottom ply overlapping said second intermediate ply; and further comprising adhesive covered by transfer tape provided on said cross strip, to provide a sealing mechanism for the return envelope.

5. A mailer as recited in claim 1 further comprising a plurality of patterns of heat sealable adhesive disposed on said first and second intermediate plies, connecting them together, and connecting said first intermediate ply to said bottom ply, along removable edge portions thereof, the fourth edge being the closest to the return envelope.

6. A mailer as recited in claim 5 further comprising adhesive patterns connecting said first intermediate ply to said top along three edges of said first intermediate ply, but not the fourth edge thereof.

7. A mailer as recited in claim 1 further comprising means defining lines of weakness in said top ply and intermediate ply corresponding to said lines of weakness in said bottom ply.

8. A mailer type business form having a plurality of quadrate plies, comprising a top ply, first and second intermediate plies, and a bottom ply;

said top ply and said first intermediate ply being of substantially the same width, and a face to face engagement, and having aligned die cut windows formed therein;

said second intermediate ply and said bottom ply forming a return envelope, said second intermediate ply having a width less than that of said first intermediate ply and said top and bottom plies, with a pair of longitudinal strips being disposed along the longitudinal edges of said bottom ply exterior of said second intermediate ply;

means defining lines of weakness in said bottom ply at the area between said second intermediate ply and said longitudinal strips; and means defining lines of weakness in said top ply and intermediate ply corresponding to said lines of weakness in said bottom ply, to allow ready detachment of edge portions of said mailer, to expose said return envelope when said edge portions are detached.

9. A mailer as recited in claim 8 further comprising adhesive patterns connecting said first intermediate ply to said top ply along three edges of said first intermediate ply, but not the fourth edge thereof.

10. A mailer as recited in claim 8 wherein said second intermediate ply has a length less than the length of said bottom ply, a cross strip being provided in said bottom ply overlapping said second intermediate ply; and further comprising adhesive covered by a release strip provided on said cross strip.

* * * * *